US009168401B2

(12) United States Patent
Botti

(10) Patent No.: US 9,168,401 B2
(45) **Date of Patent: *Oct. 27, 2015**

(54) CONVERTIBLE SUSPENSION / SEAT HARNESS

(71) Applicant: Charles Christopher Botti, Denville, NJ (US)

(72) Inventor: Charles Christopher Botti, Denville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/544,548

(22) Filed: Jan. 20, 2015

(65) Prior Publication Data

US 2015/0202475 A1 Jul. 23, 2015

Related U.S. Application Data

(63) Continuation-in-part of application No. 13/999,173, filed on Jan. 23, 2014.

(51) Int. Cl.
*A62B 35/00* (2006.01)

(52) U.S. Cl.
CPC ..... *A62B 35/0012* (2013.01); *A62B 35/0025* (2013.01); *A62B 35/0006* (2013.01)

(58) Field of Classification Search
CPC ..... A62B 35/00; A62B 35/0006; A62B 35/0012; A62B 35/0018; A62B 35/0025; A62B 35/0031; A62B 35/0037; B64D 17/30
USPC ..... 182/3, 6
See application file for complete search history.

(56) References Cited

U.S. PATENT DOCUMENTS

| | | | | |
|---|---|---|---|---|
| 2,252,998 | A * | 8/1941 | Wachtel | 182/6 |
| 2,372,557 | A | 3/1945 | Dowd | 244/151 R |
| 3,757,893 | A * | 9/1973 | Hobbs | 182/6 |
| 4,191,275 | A | 3/1980 | Mansfield, Jr. | 182/3 |
| 4,197,816 | A | 4/1980 | Lush | 182/3 |
| 4,446,943 | A * | 5/1984 | Murray | 182/3 |
| 5,036,548 | A | 8/1991 | Grilliot et al. | 2/81 |
| 5,080,191 | A * | 1/1992 | Sanchez | 182/3 |
| 5,145,027 | A * | 9/1992 | Petzl et al. | 182/3 |
| 5,220,976 | A | 6/1993 | Gunter | 182/3 |
| 5,487,444 | A | 1/1996 | Dennington | 182/6 |
| 6,128,782 | A | 10/2000 | Young | 2/69 |
| 7,036,628 | B2 * | 5/2006 | Wilcox et al. | 182/9 |
| 7,467,419 | B2 | 12/2008 | O'Neal et al. | 2/69 |
| 7,735,150 | B2 | 6/2010 | Wolfe | 2/69 |
| 8,235,173 | B2 | 8/2012 | Kopp | 182/6 |
| 8,281,894 | B2 * | 10/2012 | Mordecai et al. | 182/3 |
| 8,375,467 | B2 | 2/2013 | Real et al. | 2/69 |

(Continued)

*Primary Examiner* — Daniel Cahn
*Assistant Examiner* — Kristine Florio
(74) *Attorney, Agent, or Firm* — Ernest D. Buff & Assoc. LLC; Ernest D. Buff; Margaret A. LaCrain, Esq.

(57) ABSTRACT

A convertible suspension/seat harness is readily converted from a suspension to a seat harness and can receive a yolk for chest harness conversion. The harness includes a waist belt portion having a pair of elongated leg straps terminating at a fastening mechanism. A pair of minor straps terminates at a mating fastening mechanism adapted to mate with corresponding fastening mechanisms of the elongated leg straps to convert the harness to a suspension harness configuration. A pair of secondary straps has a secondary mating fastening mechanism adapted to mate with corresponding fastening mechanisms of the elongated leg straps to convert the harness to a seat harness configuration. A yolk is provided for attachment to the harness to yield a chest harness configuration creating a Class III style harness.

33 Claims, 10 Drawing Sheets

(56) References Cited

U.S. PATENT DOCUMENTS

| | | | | |
|---|---|---|---|---|
| 2003/0146044 | A1 | 8/2003 | Jordan | 182/3 |
| 2005/0067221 | A1* | 3/2005 | Wolner et al. | 182/3 |
| 2005/0263347 | A1* | 12/2005 | Hill et al. | 182/3 |
| 2007/0209868 | A1* | 9/2007 | Betcher et al. | 182/3 |
| 2009/0127396 | A1* | 5/2009 | Jordan | 244/151 R |
| 2010/0243373 | A1* | 9/2010 | Johnson et al. | 182/3 |
| 2010/0300802 | A1* | 12/2010 | Kopp | 182/3 |
| 2013/0175117 | A1* | 7/2013 | Schierenbeck | 182/3 |

* cited by examiner

CONVERTIBLE SUSPENSION / SEAT HARNESS

This is a Continuation-In-Part of U.S. patent application Ser. No. 13/999,173, filed Jan. 23, 2014, entitled "Fire Service Convertible Suspension/Seat Harness", the disclosure of which is hereby incorporated in its entirety by reference thereto.

BACKGROUND OF THE INVENTION

1. Field of the Invention

The present invention relates to safety harnesses; and more particularly to convertible suspension and/or seat harness systems utilized for protection against falls from heights in fire rescue, rescue operations, wind energy applications, mining applications, rope access applications, telecommunication applications, tower applications and various other industrial and construction activities.

2. Description of the Prior Art

Safety harness equipment provides protection to a person, animal or object to prevent injury or damage. Safety harnesses are worn by people as standard safety equipment. Generally, the harness is donned by a person and is connected to a stationary object via a lifeline or other suitable connection. Often, safety harnesses are used in combination with a fall arrest device to reduce any forces exerted on the person from the fall and/or regulate deceleration and prevent the person from descending at too rapid a descent.

Various design performance standards have been set forth in different jurisdictions or countries. For example, in the United States performance standards have been issued by the American National Standards Institute (ANSI) and the National Fire Protection Association (NFPA). In Canada performance standards have been issued by the Canadian Standards Association (CSA).

Safety performance standards are generally classified as Class I, Class II or Class III harness devices. Class I safety harnesses include belt harnesses, which are considered the least secure class of harness device. Class II safety harnesses include suspension and seat harnesses. Class III safety harnesses include chest harness type devices.

Various safety harnesses have been heretofore disclosed and utilized. Examples of safety harnesses can be found, as follows: U.S. Pat. No. 8,375,467 to Real et al. discloses a safety apparatus for a person at an elevated location; U.S. Pat. No. 7,735,150 to Wolfe discloses a safety harness; U.S. Pat. No. 7,467,419 to O'Neal et al. discloses a rapid extraction body harness; U.S. Pat. No. 6,128,782 to Young discloses a combination clothing/safety harness for fall arresting and rescue from confined spaces; U.S. Pat. No. 5,487,444 to Dennington discloses a Shock-absorbing safety harness; U.S. Pat. No. 5,220,976 to Gunter discloses a safety harness; U.S. Pat. No. 5,036,548 to Grilliot et al. which discloses a firefighter's combination trousers and safety harness; U.S. Pat. No. 4,446,943 to Murray discloses a fire service harness; U.S. Pat. No. 4,191,275 to Mansfield discloses a safety harness kit; U.S. Pat. No. 2,372,557 to Dowd discloses a quick-release harness construction; YatesGear.com teaches a conversion from a seat to a waist harness.

Suspension harnesses in general provide support from the crotch region of the wearer; while seat harnesses provide support in the thigh region. As a result, when the harness is being worn for a long period of time, the seat harness with support in the thigh region is more desirable as the suspension harnesses having the primary support located in the crotch region can become uncomfortable over extended periods of wear. During firefighting operations traditionally a firefighter wears a suspension harness of the Class II variety, while during technical rescue operations a separate seat harness must be donned, sometimes over the top of the suspension harness while the firefighter is riding in the responding rescue vehicle. This is not only cumbersome, but it can be dangerous as the firefighter must unbuckle his/her seatbelt in order to dress into the seat harness.

During use in wind energy applications, mining applications, rope access applications telecommunication application, tower applications and various other industrial and commercial activities, a user typically dons a Class III suspension or fall arrest harness, but cannot use the same harness comfortably in various different applications, therefore they may need to have two separate harnesses. None of the heretofore disclosed and utilized safety harnesses provide a safety harness that solves the problem associated with the need for more than one type of safety harness.

According, there is a need in the art for safety harness that can readily be converted from a suspension harness to a seat harness without the need to change harness systems or clothing. What is more, there is a need in the art for the ability to readily convert a harness from a Class II harness to a Class III harness with minimal manipulation.

SUMMARY OF THE INVENTION

The present invention provides a convertible suspension/seat harness capable of being converted from a suspension to a seat harness and capable of receiving a yolk for chest harness conversion to create a Class III harness. Uniquely, the subject conversion harness is capable of going from a Class I harness (belt), to a Class II harness (leg loops; thigh loops), to a Class III harness (chest harness), in a matter of minutes. The subject convertible suspension/seat harness provides for rear adjustment points of the harness for the leg loops to a male and female buckle that allows for the user to remove the suspension style leg loop and convert it into a seat style harness that attaches back onto itself to create an adjustable loop that grabs the thighs of the user to add support when using the harness as a technical rescue harness.

The harness includes a waist belt portion having a pair of elongated leg straps terminating at a fastening member. A pair of minor straps is provided terminating at a mating fastening member adapted to mate with corresponding fastening member of the elongated leg straps to convert the harness to a suspension harness configuration. A pair of secondary straps is provided having a secondary mating fastening member adapted to mate with corresponding fastening member of the elongated leg straps to convert the harness to a seat harness configuration. A yolk is provided for attachment to the harness to create a chest harness configuration. When the minor straps are fastened to the elongated leg straps a pair of leg loops result forming the suspension harness, and when the secondary straps are fastened to the elongated leg straps a pair of thigh loops result forming the seat harness configuration.

A method of using a convertible suspension/seat harness is also provided. The method comprises the steps of: a) securing a waist belt portion of the convertible suspension/seat harness adapted to be mounted on a waist of a user, the convertible suspension/seat harness comprising: (i) the waist belt portion having a front belt segment and a back belt segment and an attachment member for opening and closing attachment of the belt adapted to be secured on a user's waist; (ii) a pair of elongated leg straps each having a proximal and a distal end, the proximal end being arranged on the belt segment, the distal end terminating at a fastening member; (iii) a pair of minor straps each having a proximal and a distal end, the proximal end being arranged on the belt segment, the distal end terminating at a mating fastening member adapted to mate with corresponding fastening member of the elongated leg straps to convert the convertible suspension/seat harness to a suspension harness configuration; and (iv) a pair of secondary straps each having a secondary mating fastening member adapted to mate with corresponding fastening member of the elongated leg straps to convert the convertible suspension/seat harness to a seat harness configuration; b) fastening the elongated leg straps to the minor straps to convert the harness to the suspension harness configuration; c) unfastening the elongated leg straps from the minor straps; d) fastening the elongated leg straps to the secondary straps to convert the harness to the seat harness configuration. Whereby, when the minor straps are matingly fastened to the elongated leg straps a pair of leg loops result, forming the suspension harness configuration, and whereby when the secondary straps are matingly fastened to the elongated leg straps a pair of thigh loops result forming the seat harness configuration.

Advantageously, the harness of the present invention provides the ability to wear only one harness that can readily be converted from a Class I harness (belt), to a Class II harness (leg loops; thigh loops), to a Class III harness (chest harness), in a matter of minutes. There is no need to wear additional harnesses, which would otherwise be uncomfortable and cumbersome.

Significant advantages are realized by practice of the present invention. The key elements of the convertible harness of the present invention comprise, in combination, the features set forth below:

1) ready conversion to a suspension harness bottom;
2) ready conversion to a suspension harness with a yolk add-on for further conversion to include a chest harness;
3) ready conversion to a seat harness bottom;
4) ready conversion to a seat harness with a yolk add-on for further conversion to include a chest harness;
5) provides the unique advantage of multiple configurations and arrangements that eliminate the need for a second harness;
6) the harness can immediately convert from a Class I harness to a Class II harness;
7) the harness can immediately convert from a Class II harness to a Class III harness;
8) no need to carry additional harness equipment or devices;
9) no need to wear or change between multiple harness equipment or devices;

These and other advantageous are inherent to the subject convertible suspension/seat harness.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1A:
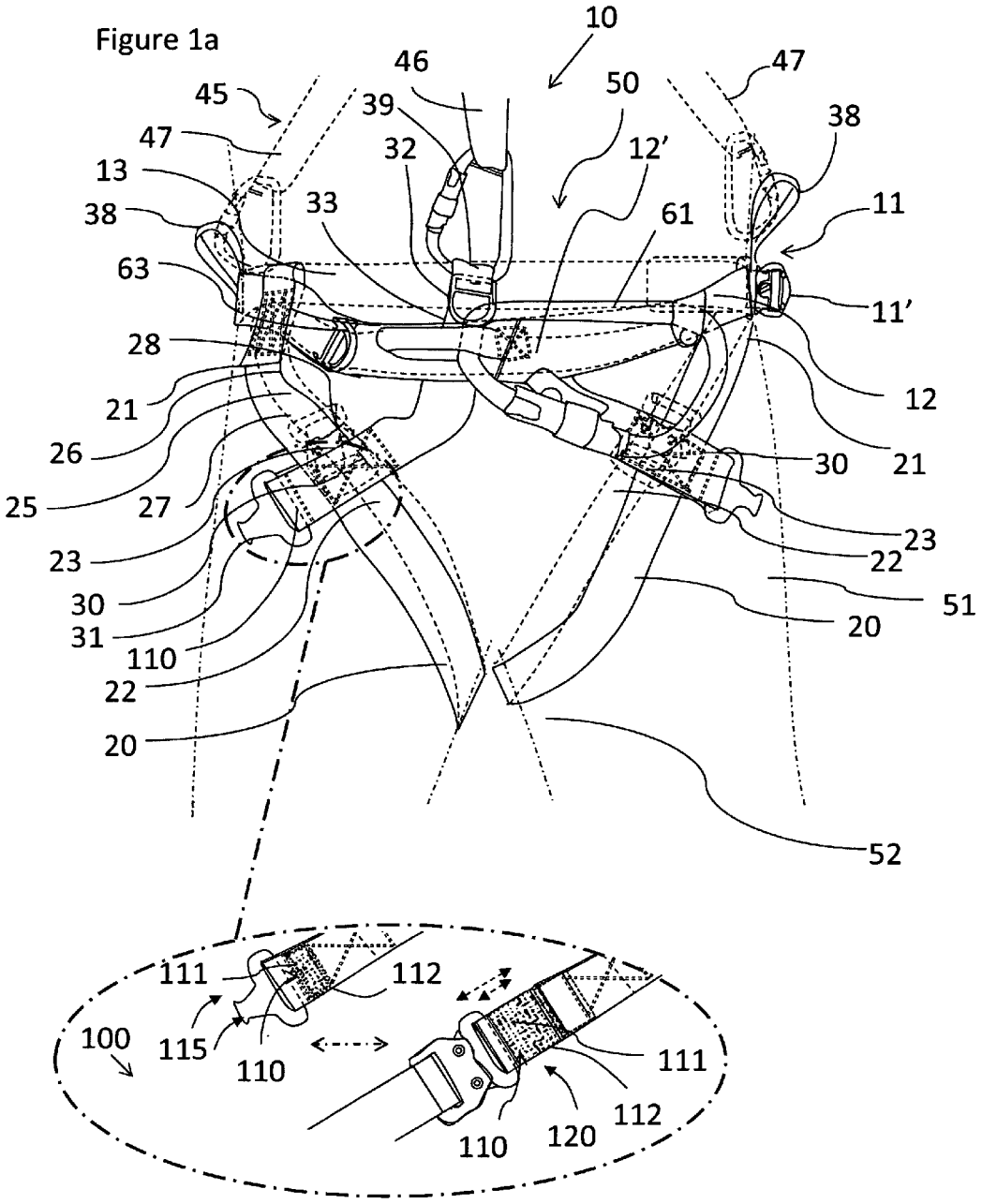
FIG. 1*a* is a front view of the convertible suspension to seat harness, showing the harness as a suspension harness as worn by a user.

The subject convertible suspension/seat harness uniquely provides easy conversion from a suspension harness to a seat harness each being with or without a chest harness. Thus, the conversion harness is capable of going from a Class I harness (belt), to a Class II harness (leg loops and waist belt), to a Class III harness (waist belt, leg loops and chest harness), in a matter of minutes. The subject convertible suspension/seat harness provides for rear adjustment points of the harness for the leg loops to a male and female buckle that allows for the user to remove the suspension style leg loop generally used in fall arrest harnesses and convert it into a seat style harness that attaches back onto itself to create an adjustable loop that grabs the thighs of the user which adds support when using the harness as a technical rescue seat style harness. Waist belt can buckle from left or right side closure. Buckles are preferred in the subject conversion harness because it provides better support and applied forces to the thigh area as opposed to the groin area.

The subject convertible suspension/seat harness modifies current harnesses to include a center D-ring attachment point to serve as an attachment point for technical rope rescue. The attachment point is created by adding two support points to attach to the front of the suspension style leg loops creating a location to attach the seat harness loops. One half of a buckle is at the distal end of the D-ring support material. A control tab is used to stow the portion of the fastening member, mating fastening member, and/or buckle against the webbing of the harness to prevent abrasion of the pants that the harness contacts. Preferably, the subject convertible suspension to seat harness is composed of nylon, polyester, aramid type fiber (such as those sold under the trade names Kevlar/Nomex) with aluminum/alloy material, steel, titanium hardware, heat resistant plastic and composite material. The material used in the leg loops of the harness may contain reflective material for heightened visibility in a smoke filled obstructed atmosphere. Moreover, the rear of the harness is fully adjustable to allow for different variations in waist size. Carabineers, hook and D-ring quick connect buckles, hook and loop material, snaps, and the like can be used to connect the upper portion of the harness to the lower portion.

The upper portion of the harness preferably consists of three separate pieces of material that are configured in a way that allows for the top portion of the harness to be able to be fully adjusted either by one or two adjustment points in the front and the rear of the harness. Preferably the harness upper portion comprises a dorsal D-ring or soft attachment point located at the rear of the upper portion of the harness as well as a front chest D-ring or soft attachment point that creates an additional attachment point.

A yolk is provided for chest harness conversion. Adding a soft or hard attachment point to two points in the rear on the waist belt and one or two points in the front on the waist of the harness allows for the addition of a top portion or yolk that facilitates conversion of the lower harness to a full body harness, called a Class III harness, either as a suspension style or seat style harness. The attachment points are preferably color coded to allow for the user to clearly see that they are attaching the upper portion correctly to the lower portion.

By providing the ability to convert a suspension harness to a seat harness, the user or wearer can convert the harness to address his/her needs. Suspension harnesses provide support in the crotch or groin area, and as a result the weight of the person is supported by the groin. Over time, this can become uncomfortable for the wearer, and due to the location in the groin area it can be difficult for the wearer to move. On the other hand, seat harnesses provide support in the thigh region. Owing to weight distribution in the thigh region and transference thereof to the legs, rather than the groin, the seat harness can be comfortably and safely worn for longer periods of time and when more maneuverability is needed. Suspension harnesses are worn daily by user; however, if rescuing a person on the side of the building, for example, it is customary that a separate seat harness system must be worn. Putting on the extra harness is oftentimes troublesome, and is necessarily carried out when the user is in transit in truck. This, in turn, creates a safety risk and the need to unbuckle one's seatbelt. Additionally, the extra harness causes more bulk and results in more cumbersome attire. In operation of the subject convertible harness, the wearer simply unbuckles the leg loop and brings it across the front of the thigh to convert from a suspension style harness to a seat harness. As a result, the user only has to wear one safety harness that is capable of converting from a suspension harness to a seat harness as needed. Moreover, the wearer can readily add a yolk to create a chest harness, converting the harness to a Class III harness as needed for safety.

Conversion from a Class II harness to a Class III harness is provided by way of the subject conversion harness assembly. A Class III harness is provided as the belt (Class I) with leg loops (Class II) is attached to the upper portion/yolk to provide a chest harness (Class III). Class III allows inversion or sideways descent without falling from the harness. Preferably, the subject harness and yolk are color coded to make sure that the yolk is not put on upside-down (i.e. red on the right hand side that connects to the red; blue on the left hand side that connects to the blue on the yolk). The yolk and/harness has height adjustment members, (e.g. buckles, three bar slide harness adjusters and other suitable adjustment members) and is preferably composed of nylon and/or polyester. Most preferably, the yolk and/harness are composed of Kevlar so that it is lighter and stronger in operation.

The subject conversion harness provides the ability to readily convert from a Class I harness, to a Class II harness, and a Class III harness as necessary. Though the application herein described is especially well suited for use by a user, it will be understood by those skilled in the art that the conversion harness is well suited for use in rescue operations, military operations, sporting activities, law enforcement operations, construction and industrial applications.

Figure 1B:
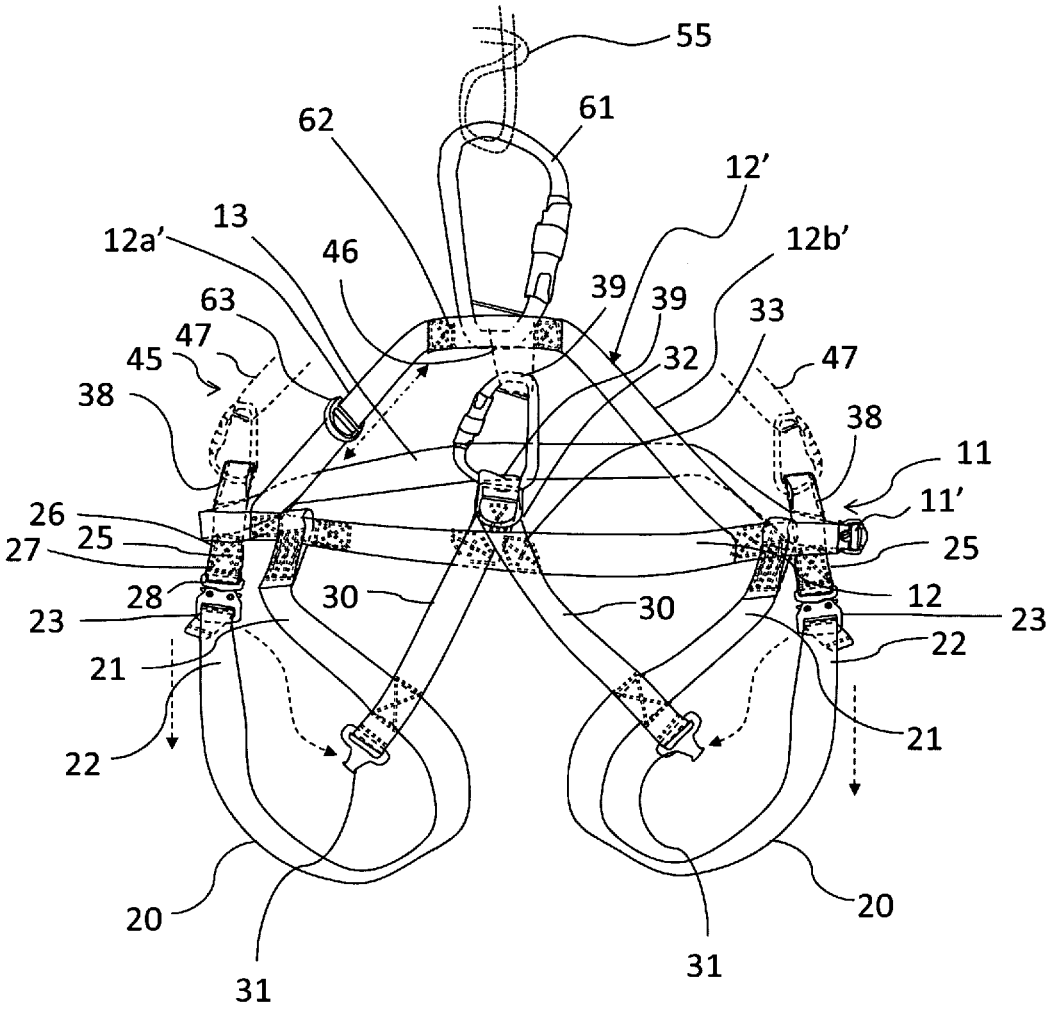
FIG. 1*b* is a top plan view of the convertible suspension to seat harness of FIG. 1*a* as shown in the suspension harness mode, showing the optional A-Frame construction in an extended configuration as when the A-Frame is deployed for use by the user.
Figure 2:
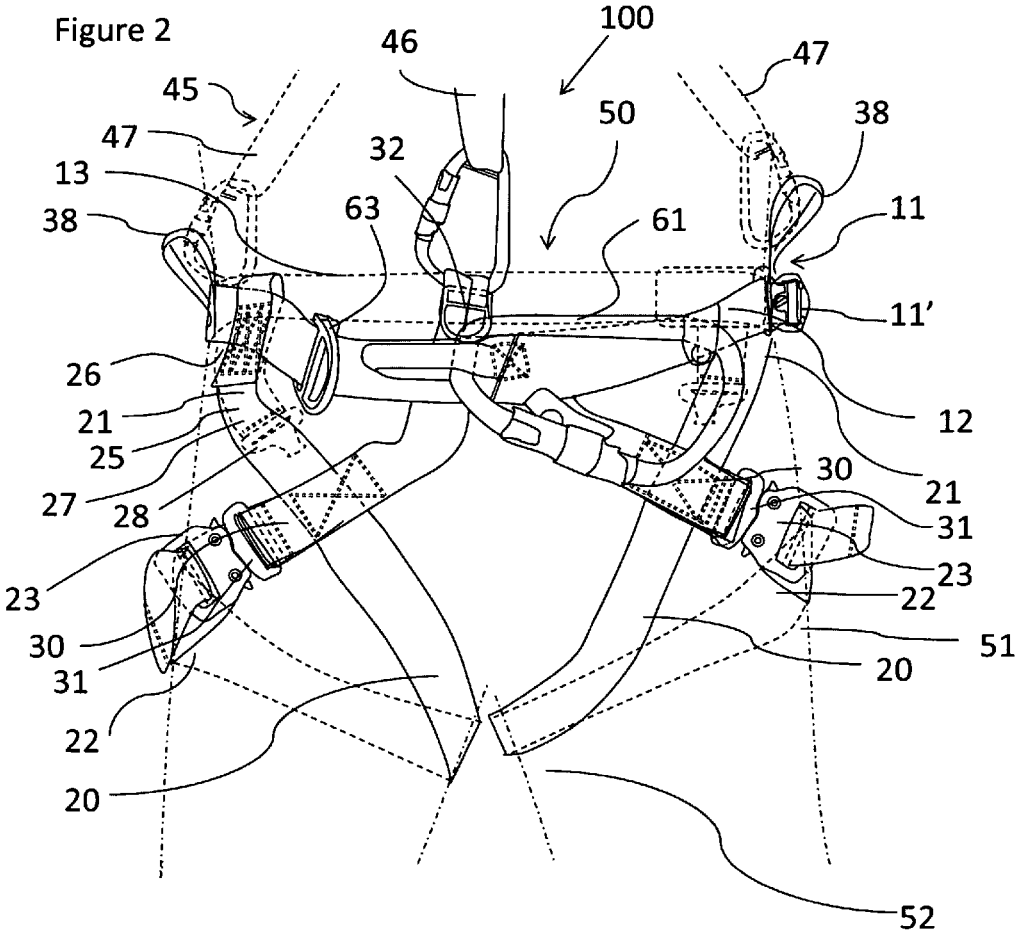
FIG. 2 is a front view of the convertible suspension to seat harness, showing the harness of FIG. 1 converted to a seat harness as worn by a user.
Figure 3A:
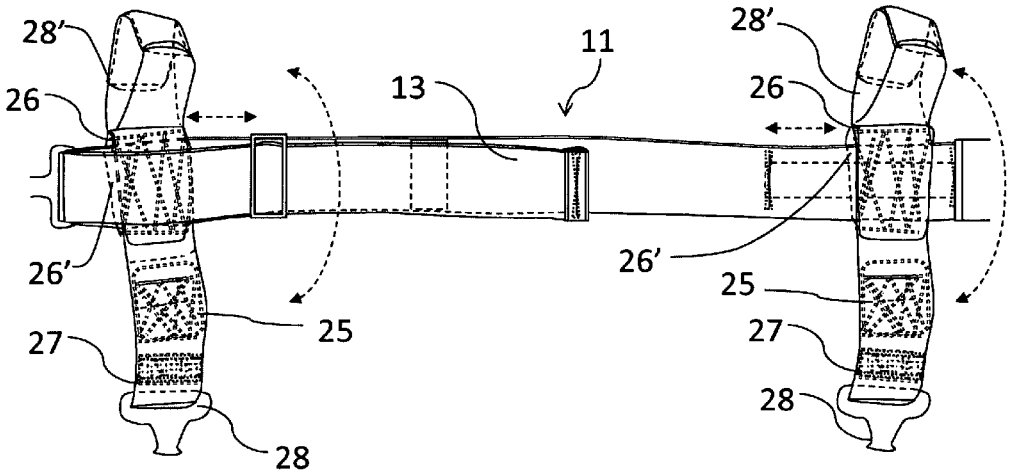
FIG. 3*a* is a top plan outward/exterior sectional view of a portion of the back belt segment of the waist belt portion, showing that the minor straps which provide the suspension harness mode of FIG. 1*a;*
Figure 3B:
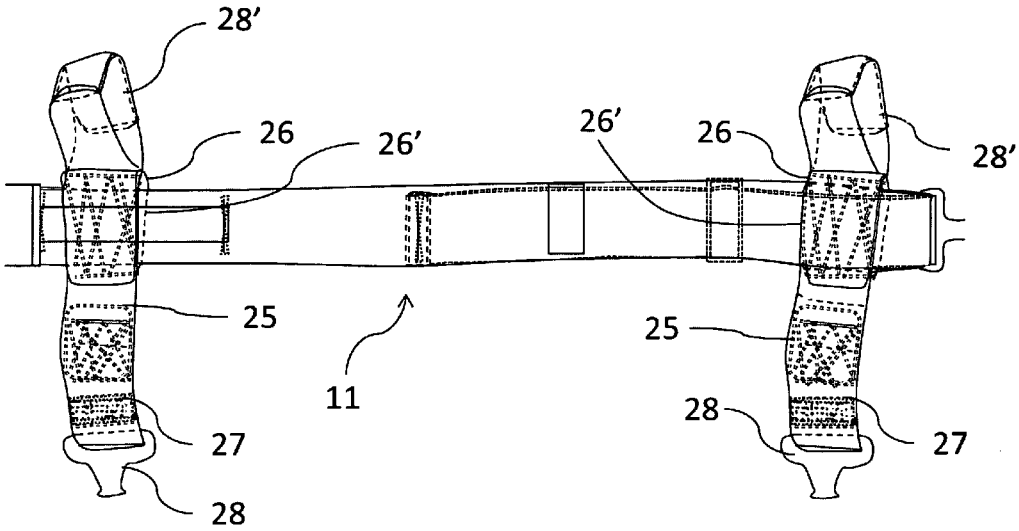
FIG. 3*b* is a top plan inside sectional view of FIG. 1*c*, showing that the minor straps that are interconnected and float on the waistband to provide the suspension harness mode of FIG. 1*a;*

FIG. 1*a* is a front view of the convertible suspension to seat harness. The convertible suspension to seat harness, shown generally at 10, is depicted in the suspension harness mode, and is appointed to be worn by a user. FIG. 1*b* is a top plan view of the convertible suspension to seat harness of FIG. 1*a* as shown in the suspension harness mode, showing the optional A-Frame construction in an extended configuration as when the A-Frame is deployed for use by the user. FIG. 2 is a front view of the convertible suspension to seat harness, shown generally at 100. In FIG. 2 the harness of FIG. 1 has been converted to a seat harness mode and is appointed to be worn by a user. FIG. 3*a* is a top plan outward sectional view of a portion of the back belt segment of the waist belt portion, showing how the minor straps are attached/interconnected to provide the suspension harness mode of FIG. 1*a*. FIG. 3*b* is a top plan inward sectional view of FIG. 3*a*, showing how the minor straps are attached/interconnected to provide the suspension harness mode of FIG. 1*a*. When converted from suspension harness mode to seat harness mode these attachment points are temporarily no longer used to attach the leg loop to the waistbelt but may be used to attach the upper yoke to form the Class III Harness configuration.

Referring to FIGS. 1*a*-3*b*, the convertible suspension/seat harness is constructed having a waist belt portion 11. Waist belt portion 11 includes a front belt segment 12, optional A-Frame front belt segment 12', and a back belt segment 13, as well as an attachment member 11' (preferably a buckle) for opening and closing attachment of the belt 11 front belt segment 12 and back belt segment 13 for mounting on a user's 50 waist. Although a buckle is shown as an attachment member, it is recognized that the other suitable attachment members, such as but not limited to a snap hook, a carabineer, a quick connect buckle, a tongue buckle, a web loop (choking a web loop to another web loop) a sewn attachment, a riveted attachment, and a knot could be used. The waist belt 11 is fully adjustable to allow for different variations in waist size. Preferably, the waist belt portion comprises three separate pieces of material configured having at least one adjustment point in the front or rear of the harness; comprising front belt segment 12, A-Frame front belt segment 12' and back belt segment 13 (see FIG. 1*b*). A large carabineer or pompier hook 61 is arranged on A-Frame front belt segment 12'. Optional A-Frame front belt segment 12' is shown in a folded or stowed configuration in FIG. 1*a*, wherein the A-Frame is folded and tucked away against front belt segment 12. FIG. 1*b* shows a top plan view of FIG. 1*a* showing the A-Frame in the deployed position as when the large carabineer 61 is clipped to a rope 55 and, for example, the user is escaping a building.

A pair of elongated leg straps 20 is mounted on belt portion 11. These elongated leg straps 20 are adjustable in length to accommodate user's different heights. Elongated leg straps 20 have a proximal end 21 and a distal end 22. Proximal end 21 is arranged on waist belt portion 11, preferably on front belt segment 12 as shown. Distal end 22 terminates at a fastening member 23. Preferably, fastening member 23 are formed as buckles or male/female snaps or buckles. Although a quick connect buckle assembly is shown as the fastening member, it is recognized that other suitable fastening members, such as but not limited to a locking quick connect buckle assembly, a tongue buckle assembly, a pass-thru buckle assembly, a mating buckle assembly and a snap buckle assembly.

A pair of minor straps 25 is provided movable or floating transversely along at least a portion of the back belt segment 13 of waist belt 11, each having a proximal end 26 and a distal end 27. Proximal end 26 is arranged on the waist belt 11. Proximal end 26 terminates to a fastening member, herein shown as a loop 28' via soft attachment point adapted to receive a carabineer, clip, or the like. Distal end 27 terminates at a mating fastening member 28 adapted to mate with a corresponding fastening member 23 of each of the elongated leg straps 20 to convert the convertible suspension/seat harness to a suspension harness configuration as shown at 10 in FIG. 1. Leg straps 20 are adapted to be unfastened from the minor straps 25 as indicated by way of the phantom arrow. Leg straps 20 are then adapted to be attached to a pair of secondary straps 30 to convert the harness to a seat harness, the configuration of which is shown in FIG. 2. FIGS. 3*a*-3*b* illustrate the arrangement of the minor straps 25. FIG. 3*a* shows a top plan outward sectional view of a portion of the back belt segment 13 of the waist belt portion 11 wherein the minor straps 25 are attached/interconnected to provide the leg loop attachment point for the suspension harness mode and the upper yoke attachment point of FIG. 1*a*. FIG. 3*b* shows a top plan inward sectional view of a portion of the back belt segment 13 of the waist belt portion 11 wherein showing how the minor straps 25 are attached/interconnected to the waist-belt forming the suspension harness mode and upper yoke attachment point of FIG. 1*a*. Proximal end 26 of minor straps 25 is preferably constructed having a slit 26' or gap wherein the straps 25 are mounted on waist belt portion 11 in a manner which allows the minor straps 25 to slide to and fro and pivot along waist belt portion 11 for comfort adjustment purposes. Additionally, as constructed, slit 26' provides the ability to slide or pivot minor straps 25 while keeping the minor straps 25 in a relative position on the waist belt. As a result, the minor straps 25 are adapted to move to-and-fro or float on the waist belt portion 11 while also being capable of sliding or pivoting when attaching the upper yoke forming the Class III Harness either in suspension or seated mode shown in FIGS. 1*a*, 2.

Secondary straps 30 are provided having a secondary mating fastening member 31 adapted to mate with corresponding fastening member 23 of the elongated leg straps 20 to convert the convertible suspension/seat harness to a seat harness configuration as shown in FIG. 2 at 100. When the minor straps 25 are matingly fastened to the elongated leg straps 20 a pair of leg loops (FIG. 1) result forming the suspension harness configuration 10. Conversely, when the secondary straps 30 are matingly fastened to the elongated leg straps 20 a pair of thigh loops (FIG. 2) result, forming the seat harness configuration 100.

Fastening members for the harness preferably are provided as mating male and female buckles. Buckles are preferred because they provide better support and applied forces to the thigh area of the user, shown generally at 51 as opposed to the groin area of the user, shown generally at 52. Preferably, a control tab 110 is used to stow a portion of the fastening member, mating fastening member, and/or buckle against webbing of the harness to prevent abrasion of pants the harness contacts and may be integrated within fastening members 23, mating fastening members 28, and/or secondary mating fastening member 31. A blown-up view of an embodiment of the control tab 110 is shown generally at 100 in FIG. 1*a*. Control tab 110 is constructed as an elastic/expandable portion 111 stowed within a cavity 112 within the fastening member's (20, 25, 30) distal end's strap or webbing. When the control tab 110 is stowed within the cavity 112 it is in a contracted configuration, preferably stowing at least a portion of the fastening members, as shown at 115. Conversely, when a force is applied to the fastener portions, such as when the members are matingly fastened during wear, control tab 110 elastic portion 111 expands, extending control tab 110 from the cavity 112, to yield an expanded configuration, as shown at 120. Control tab 110 is used to stow the portion of the fastening member, mating fastening member, and/or buckle against the webbing of the harness to prevent abrasion of the pants that the harness contacts. Reflective material for heightened visibility in a smoke filled obstructed atmosphere is preferably integrated within the elongated leg straps 20, and/or the secondary straps 30 and/or minor straps 25, and/or belt 11.

Preferably, the proximal end 21 of the elongated leg straps 20 and secondary straps 30 are arranged on the front belt segment 12, and the proximal end 26 of the minor straps 25 are arranged on the back belt segment 13 as shown. The convertible suspension/seat harness further comprises a center D-ring attachment point 32 adapted to serve as an attachment point for technical rope rescue. The center D-ring attachment point 32 is located at a point of termination of the proximal ends 33 of the pair of secondary straps 30. A sliding D-ring attachment point for the escape system is optionally also provided at 63 arranged on A-Frame 12' (for further clarity see FIG. 1*b*). As shown more clearly in FIGS. 4-7, secondary straps 30 are preferably formed together as an inverted "v" shape configuration.

Referring to FIG. 1*b*, A-Frame front belt segment 12' is comprised of a left side 12*a'* and a right side 12*b'* with a central region 62 removably/or fixedly attached to carabineer 61. A sliding D-ring attachment point for an escape system is optionally also provided at 63 slidingly arranged on either left side 12*a'* or right side 12*b'*, herein shown on left side 12*a'*. A-frame 12' creates an increase in center of gravity so that the center gravity weight is predominately localized to the chest area. With this arrangement, the user is less likely to flip upside down when descending. As a result, the subject harness can not only be converted from a Class I belt harness, to a Class II suspension or seat harness, to a Class III with chest harness, but the A-Frame 12' further provides multiple uses and functions.

A yolk 45 is also provided for further conversion of the harness 10 (suspension harness mode/configuration) and/or 100 (seat harness mode/configuration) to a chest harness, further converting either harness 10, 100 from a Class II harness to a Class III safety harness. FIGS. 1 and 2 show a front strap 46 and dual rear/rear side straps 47 of yolk 45 of the y-shaped type chest harness construction. The harness comprises D-rings or soft attachment points 38 at sides or on or near the back waist belt and at least one D-ring or soft attachment point 39 at the front belt to provide attachment points for the yolk 45. Specifically, dual rear/rear side straps 47 of yolk 45 are adapted to attach to attachment points 38 at the back/sides of waist belt 11, while front strap 46 of yolk 45 is adapted to attach to attachment point 39 at the front of the waist belt 11. Note that the configuration of yolk 45 is shown as the chest belt conversion of the subject harness, it is to be understood that other types of chest belts are contemplated, including vest type chest harnesses, chest harnesses in general, as well as other types of y-shaped yolk type chest harness constructs. Yolk 45 is shown as a y-shaped type chest harness and is discussed hereinafter in detail in FIGS. 8 and 9. Attachment points 38 are preferably color coded (left: blue; right: red, for example) and the yolk 45 has correspondingly color coded yolk straps 47 (left 47: blue; right 47: red, for example) adapted to facilitate correct attachment of the yolk to the convertible suspension/seat harness.

Figure 4:
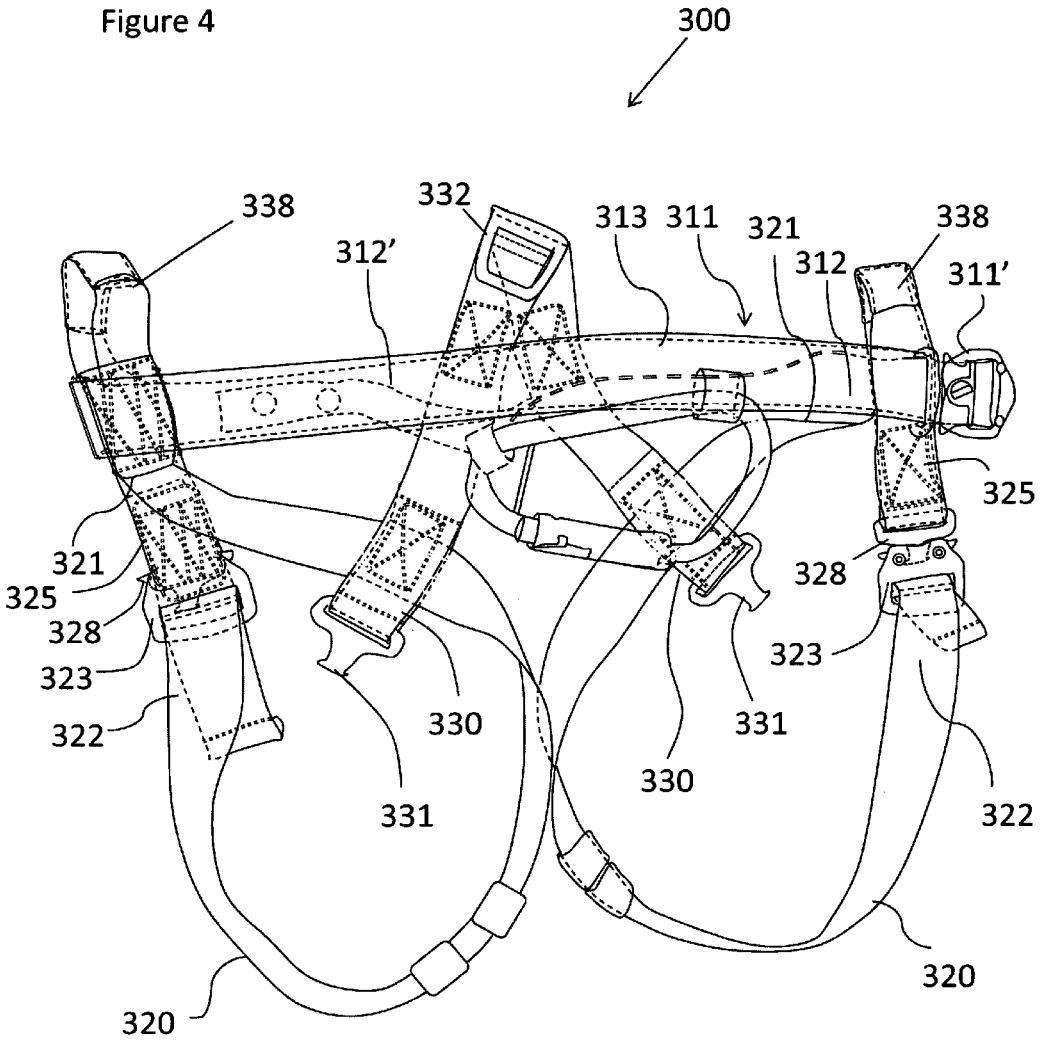
FIG. 4 is a plan front view of the convertible suspension to seat harness, showing the harness as a suspension harness.
Figure 5:
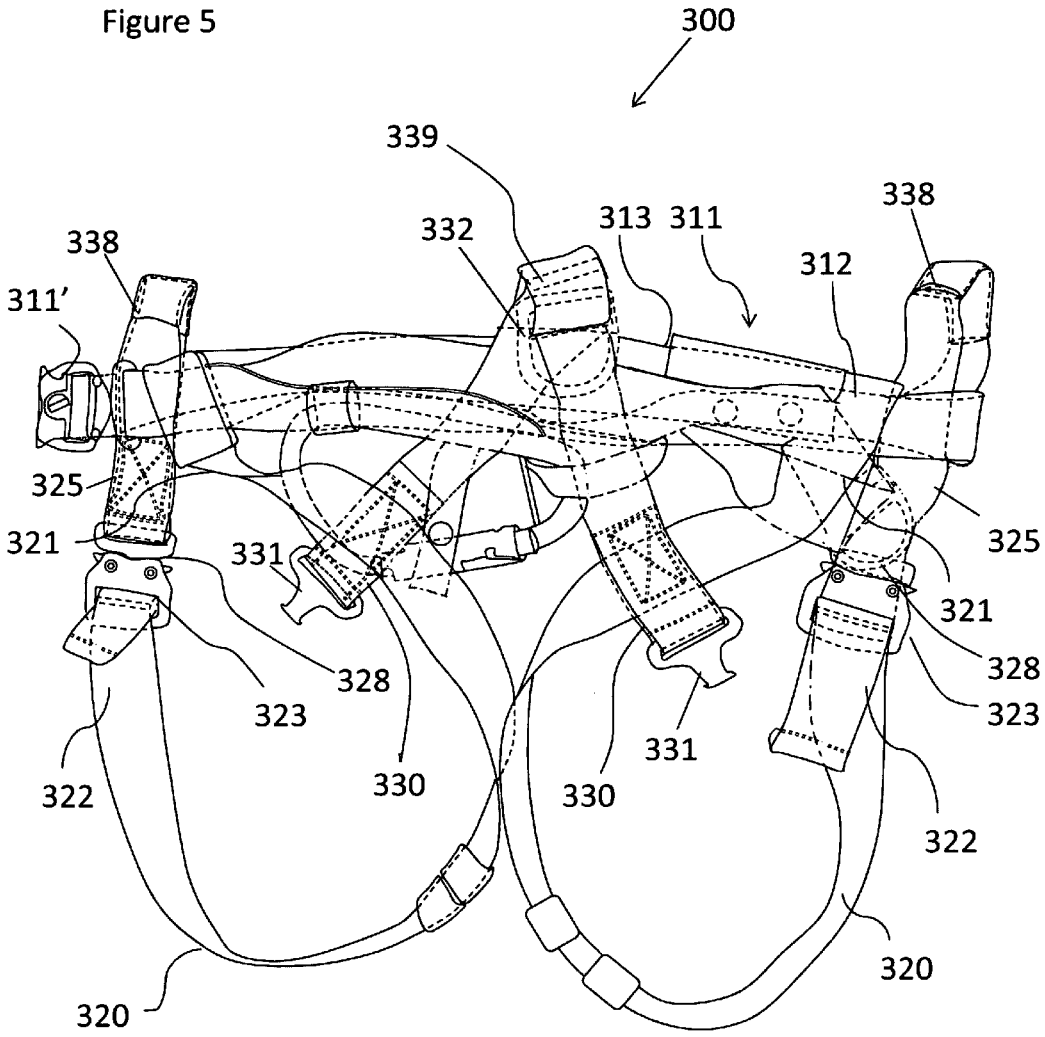
FIG. 5 is a plan back view of the convertible suspension to seat harness, showing the harness as a suspension harness.
Figure 6:
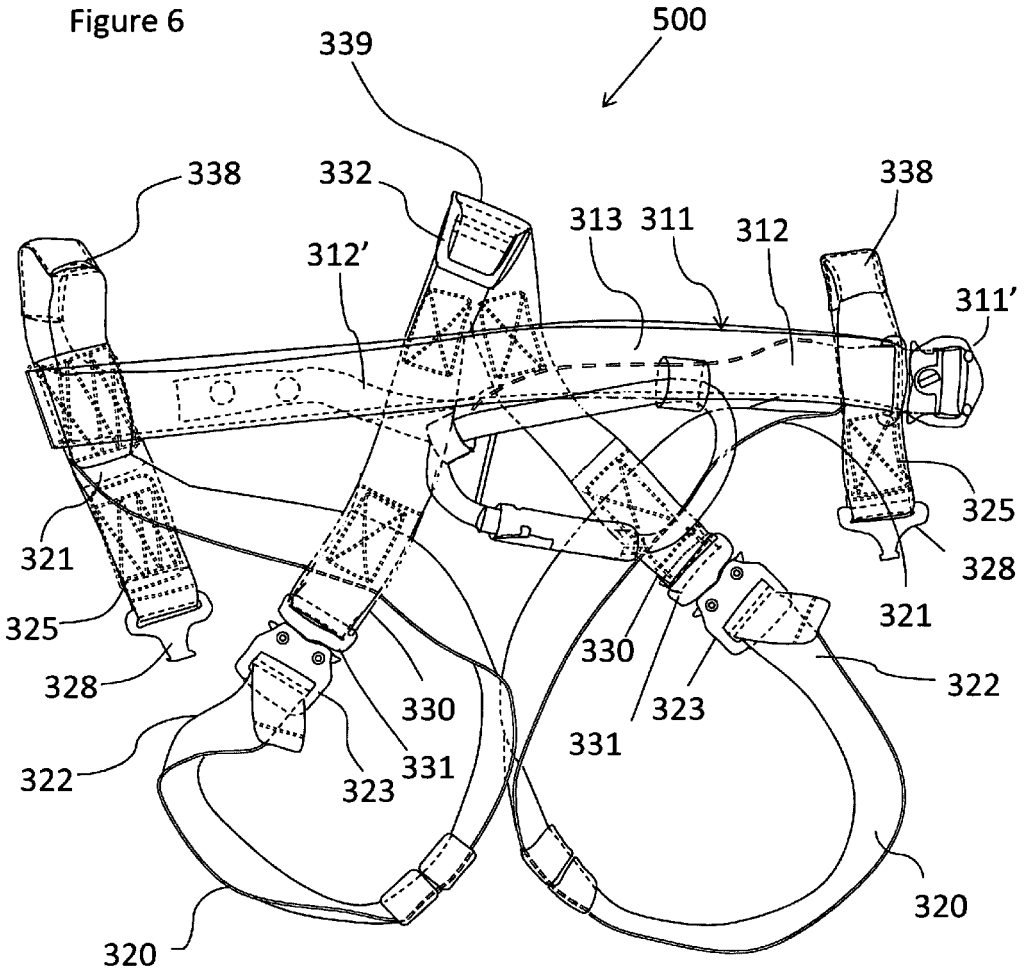
FIG. 6 is a plan front view of the convertible suspension to seat harness, showing the harness of FIG. 4 converted to a seat harness.
Figure 7:
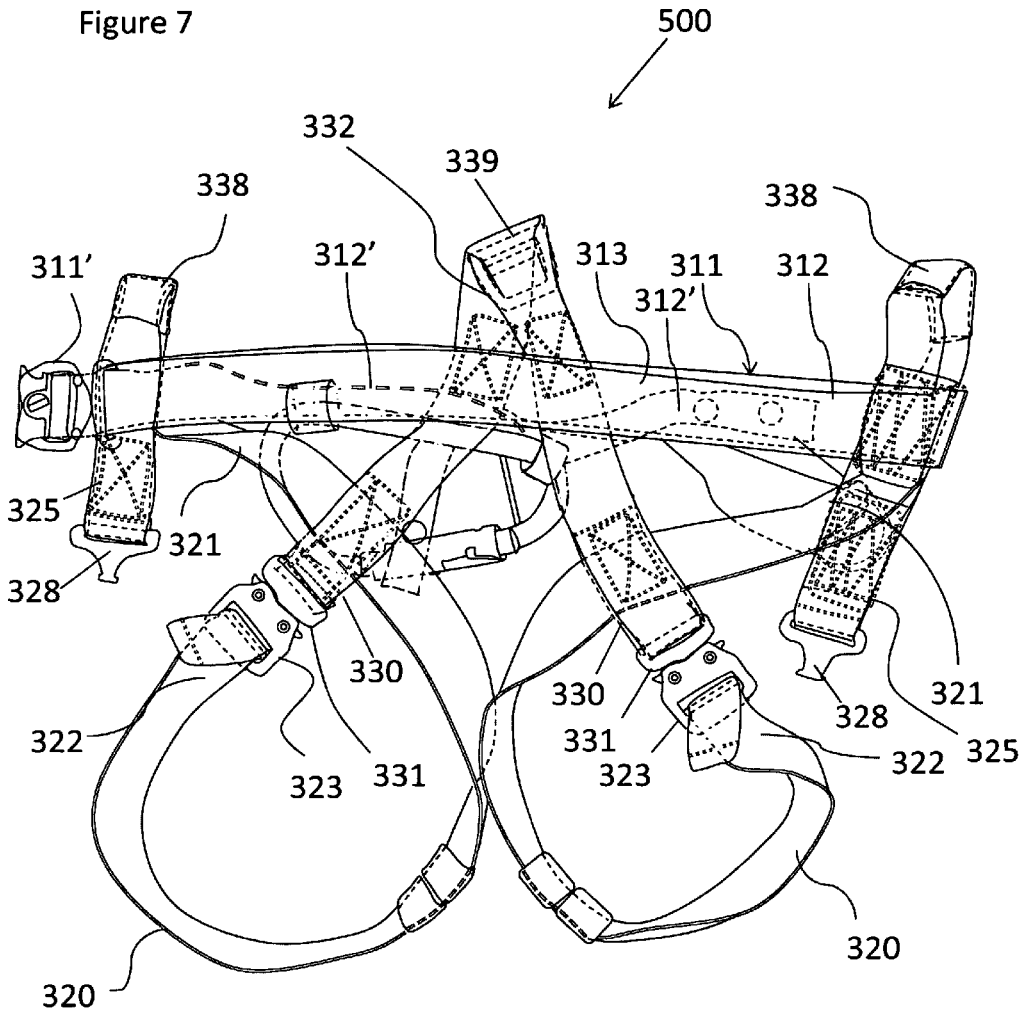
FIG. 7 is a plan back view of the convertible suspension to seat harness, showing the harness of FIG. 6 converted to a seat harness.

FIGS. 4 and 5 illustrate plan views of an embodiment of the convertible suspension to seat harness, showing the harness as a suspension harness, shown generally at 300. FIG. 4 shows a front view; FIG. 5 shows a back/rear view. FIGS. 6 and 7 illustrate plan views of an embodiment of the convertible suspension to seat harness of FIGS. 4 and 5, showing the harness converted to a seat harness, shown generally at 500. FIG. 6 shows a front view of the seat harness conversion; FIG. 7 shows a back/rear view of the seat harness conversion.

Referring to FIGS. 4-7, the convertible suspension/seat harness is constructed having a waist belt portion 311 that comprises a front belt segment 312, a back belt segment 313, and an optional A-Frame segment 312' (see FIG. 1*b* for construction of the A-Frame segment), as well as attachment member for opening and closing attachment of the belt 311 for mounting on a user's waist. It is noted that the A-Frame segment 312' is optional and therefore the waist belt portion 311 may only comprise front belt segment 312 and back belt segment 313. The waist belt 311 is fully adjustable to allow for different variations in waist size and is opened and closed for removal and attachment to the waist of a user by way of a waist belt buckle 311'. Preferably, the waist belt portion comprises three separate pieces of material (front belt 312, back belt 313, and secondary front belt/A-Frame (see FIG. 1*b*) at 312' which contains a sliding D-ring, a carabineer, or different types of hooks) configured having at least one adjustment point in the front and/or rear of the harness. A pair of adjustable elongated leg straps 320 is mounted on belt portion 311. Elongated leg straps 320 have a proximal end 321 and a distal end 322. Proximal end 321 is arranged on waist belt portion 311 while distal end 322 terminates at a fastening member 323, preferably being a male/female mating snap buckle. A pair of minor straps 325 having a proximal end and a distal end terminating at a mating fastening member 328 is arranged on the belt 311. Mating fastening member 328 is again preferably a male/female mating snap buckle that is adapted to mate with corresponding fastening member 323 of the elongated leg straps 320 to convert the convertible suspension/seat harness to a suspension harness configuration as shown in FIGS. 4 and 5.

To convert the harness from the suspension harness 300 to the seat harness 500, a pair of secondary straps 330 is provided having a secondary mating fastening member 331 adapted to mate with corresponding fastening member 323 of the elongated leg straps 320 as shown in FIGS. 6 and 7. When the minor straps 325 are matingly fastened to the elongated leg straps 320 a pair of leg loops result, forming the suspension harness configuration 300. Conversely, when the secondary straps 330 are matingly fastened to the elongated leg straps 320 a pair of thigh loops result, forming the seat harness configuration 500.

The convertible suspension/seat harness further comprises a center D-ring attachment point 332 adapted to serve as an attachment point for technical rope rescue. The center D-ring attachment point 332 is located at a point of termination of the proximal ends of the pair of secondary straps 330. As shown, secondary straps 330 are formed together as an inverted "v" shape configuration.

The harness comprises D-rings or soft attachment points 338 at sides or the back belt and at least one D-ring or soft attachment point 339 at the front belt to provide attachment points for a yolk. The yolk is shown in detail in FIGS. 8 and 9, and is adapted to allow conversion of the suspension/seat harness further to a chest harness.

Figure 8:
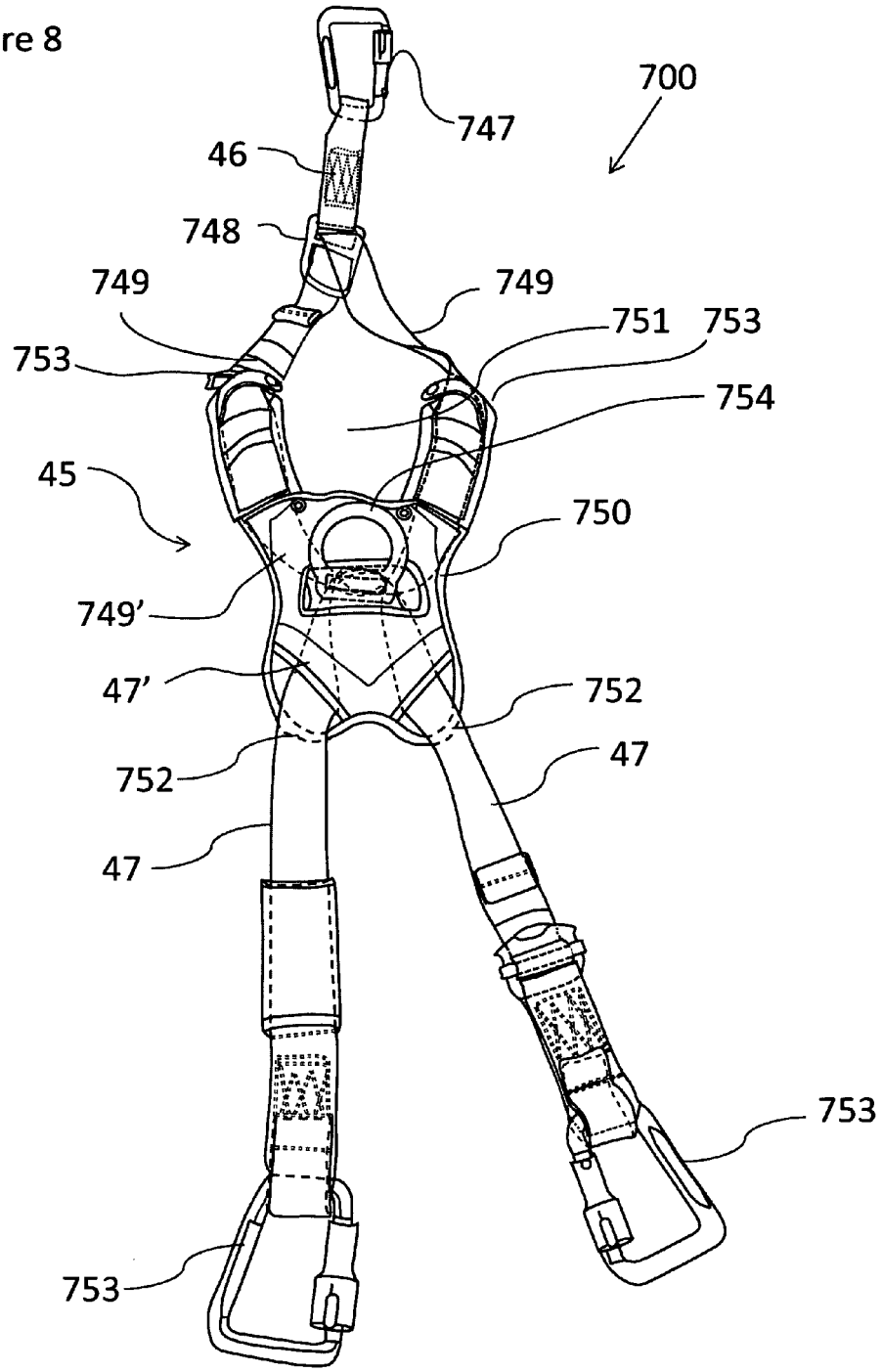
FIG. 8 is a plan front view of the yolk of the convertible suspension to seat harness.
Figure 9:
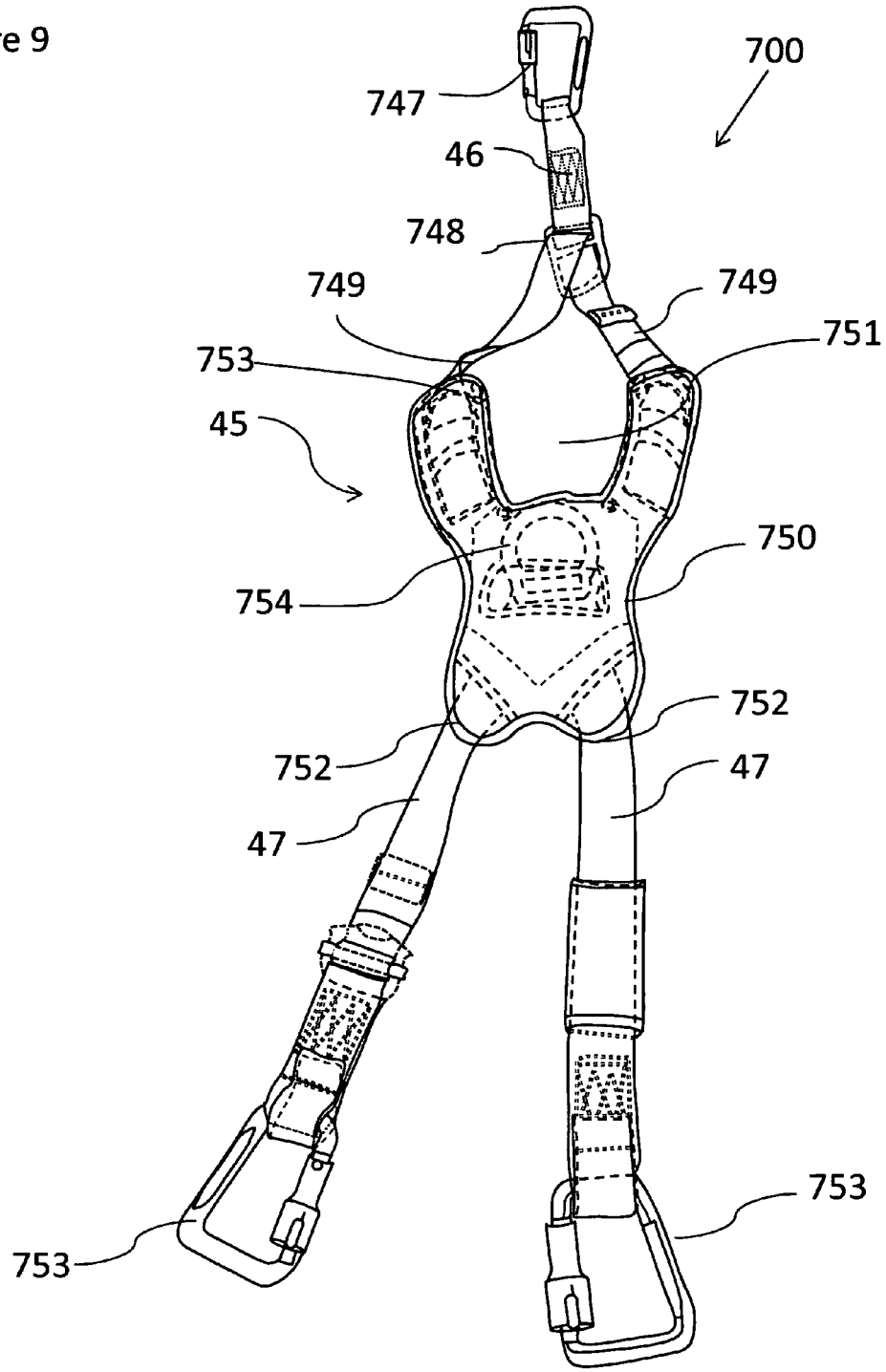
FIG. 9 is a plan back view of the yolk of the convertible suspension to seat harness of FIG. 8.

Referring to FIGS. 8 and 9, there is shown generally at 700 plan front and back views of the yolk, respectively. Yolk 45 is provided for further conversion of the harness of FIGS. 1-7 to a chest harness, meeting Class III safety standards. Yolk 45 is constructed having a front strap 46 and dual rear/rear side straps 47. The harness comprises D-ring or soft attachment points at sides or the back belt and a D-ring or soft attachment point at the front belt to provide attachment points for the yolk as discussed herein. Attachment points of the harness are color coded to correspond to color coded straps 47 so that the user can readily mount the yolk by matching the color code for correct attachment of the yolk to the convertible suspension/seat harness. Front strap 46 is attached to a carabineer 747 for attachment to the D-ring or soft attachment point of the front belt of the harness. Front strap 46 terminates to a chest D-ring 748 and two bands 749 branch out and traverse a comfort back mount 750 having padding and netting. Bands 749 include adjustment member to accommodate the height of the user. Bands 749 and back mount 750 form an opening 751 adapted to receive the user's head. Back mount 750 receives bands 749 therein and maintains the bands integrity preventing the bands from twisting. In one embodiment bands 749 are formed from a single webbing band 749' that traverse into back mount 750 and loops inside back mount 750 to exit back mount 750 at apertures 753, thus forming bands 749 (see FIG. 8); in turn, dual rear/rear side straps 47 are preferably formed from a single webbing band 47' that traverses into back mount 750 and loops inside back mount 750 to exit back mount 750 at aperture 752, thus forming bands 47 (see FIG. 8). A dorsal ring 754 is provided to create a linkage between webbing 749' and webbing 47' and provide an additional attachment point. Rear straps 47 include adjustment member so that the straps can be adjusted to accommodate the height of the user, and the straps 47 terminate at carabineers 753 for attachment to the dorsal rings or soft attachment points at sides of the back belt. It is recognized that any suitable type of adjustment member could be used to adjust the lengths of the webbing. In addition to those previously listed examples of suitable adjustment members include but are not limited to REVOLVER Buckle™, a speed adjuster, a speed parachute buckle, and a cam adjuster. Through use of the yolk, the harness can further be converted to a Class III harness, providing a chest harness, so that the wearer cannot fall out of the harness if it is inverted during descent.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A convertible harness configured to convert between a suspension harness configuration and a seat harness configuration, the convertible harness comprising:

a) a waist belt portion having a front belt segment and a back belt segment and an attachment member configured to open and close an attachment of said belt portion configured to be secured on a user's waist;

b) a pair of elongated leg straps each having a proximal and a distal end, said proximal end being arranged on said waist belt, said distal end terminating at a fastening member;

c) a pair of minor straps each having a proximal and a distal end, said proximal end of each of said minor straps being arranged on said waist belt, said distal end of each of said minor straps terminating at a mating fastening member configured to mate with a respective one of said fastening members of said elongated leg straps to convert said convertible harness into the suspension harness configuration;

d) a pair of secondary straps each having a secondary mating fastening member configured to mate with a respective one of said fastening members of said elongated leg straps to convert said convertible harness into the seat harness configuration; and e) said proximal end of said minor straps having a loop surrounding said waist belt portion in a manner which allows said minor straps to slide to and fro with respect to a major longitudinal axis of said waist belt portion and pivot along said waist belt portion, said loops surrounding said waist belt portion forming leg loop attachment points for said suspension harness configuration;

whereby, when said mating fastening members of said minor straps are matingly fastened to said fastening members of said elongated leg straps a pair of leg loops are formed to convert said harness into said suspension harness configuration, and whereby when said secondary mating fastening members of said secondary straps are matingly fastened to said fastening members of said elongated leg straps a pair of thigh loops are formed to convert said harness into said seat harness configuration.

2. The convertible harness as recited by claim 1, wherein said fastening members, mating fastening members and secondary mating fastening members are formed as mating male or female buckles.

3. The convertible harness as recited by claim 1, wherein said elongated leg straps are adjustable in length.

4. The convertible harness as recited by claim 1, wherein said proximal ends of said elongated leg straps are arranged on said front belt segment, said proximal ends of said minor straps are arranged on said back belt segment, and said secondary straps are arranged on said front belt segment.

5. The convertible harness as recited by claim 1, wherein said attachment member configured to open and close the attachment of said waist belt portion comprises a buckle between said front and back belt segments for left or right side closure of said waist belt portion.

6. The convertible harness as recited by claim 1, comprising a center D-ring attachment point adapted to serve as an attachment point for technical rope rescue.

7. The convertible harness as recited by claim 6, wherein the center D-ring attachment point is located at a point of termination of each of the proximal ends of said pair of secondary straps.

8. The convertible harness as recited by claim 1, wherein a control tab is used to stow a portion of said fastening members against a webbing of said harness to prevent abrasion of pants onto which said harness is mounted.

9. The convertible harness as recited by claim 1, comprising reflective material for heightened visibility in a smoke filled obstructed atmosphere.

10. The convertible harness as recited by claim 1, wherein said waist belt portion of said harness is fully adjustable to allow for different variations in waist size.

11. The convertible harness as recited by claim 1, wherein said waist belt portion comprises three separate pieces of material configured to have at least one adjustment point in a front or a rear of the harness, said waist belt portion comprising said front belt segment and said back belt segment and an A-frame belt segment.

12. The convertible harness as recited by claim 11, wherein said A-frame belt segment comprises a left side and a right side with a central region removably or fixedly attached to a carabineer, and wherein a sliding D-ring attachment member is located on either one of said left or said right side of said A-frame belt segment.

13. The convertible harness as recited by claim 1, comprising a carabineer.

14. The convertible harness as recited by claim 1, comprising D-rings or attachment points at sides of said back belt segment and a D-ring or attachment point at said front belt segment for attaching a chest harness.

15. The convertible harness as recited by claim 14, wherein said attachment points at sides of said back belt segment and said attachment point at said front belt segment are color coded and said chest harness has correspondingly color coded straps adapted to allow correct attachment of said chest harness to said convertible harness.

16. The convertible harness as recited by claim 14, wherein said chest harness is a yoke or y-shaped chest harness.

17. The convertible harness as recited by claim 16, wherein said yoke or y-shaped harness comprises a front strap and rear side straps, wherein said front strap is attached to a carabineer for attachment to the D-ring or attachment point of the front belt segment of the harness and terminates at a chest D-ring where two bands branch out and traverse a comfort back mount having padding and netting, said back mount receiving said bands therein and configured to maintain integrity of said bands to prevent the bands from twisting, and wherein the bands are configured to traverse said back mount and exit said back mount at rear apertures to render the rear side straps as terminating at carabineers for attachment to said harness.

18. A convertible harness, comprising:

a) a waist belt portion configured and arranged to be secured about a user's waist;

b) a pair of elongated leg straps each having a proximal end and a distal end, said proximal end being operatively connected to the waist belt portion, said distal end including a first fastener portion;

c) a pair of minor straps each having a proximal end and a distal end, said proximal end of said minor straps being operatively connected to the waist belt portion, said distal end of said minor straps including a second fastener portion configured and arranged to mate with the first fastener portion to form a suspension harness configuration; and d) a pair of secondary straps each having a proximal end operatively connected to the waist belt portion and having a distal end with a third fastener portion configured and arranged to mate with the first fastener portions to form a seat harness configuration;

e) said proximal end of said minor straps having a loop surrounding said waist belt portion in a manner which allows said minor straps to slide to and fro with respect to a major longitudinal axis of said waist belt portion and pivot along said waist belt portion, said loops surrounding said waist belt portion form leg loop attachment points for said suspension harness configuration;

wherein the first fastener portions are configured to be directly connected to respective ones of said second fastener portions to form the suspension harness configuration, and wherein the first fastener portions are configured to be directly connected to respective ones of said third fastener portions to form the seat harness configuration.

19. The convertible harness of claim 18, wherein the first fastener portions are female buckle portions and the second and third fastener portions are male buckle portions.

20. The convertible harness of claim 18, further comprising an attachment configured and arranged to open and close the waist belt portion.

21. The convertible harness of claim 20, wherein the attachment is a buckle.

22. The convertible harness of claim 18, wherein the waist belt portion includes a front belt segment, a back belt segment, and an attachment member configured and arranged to open and close an attachment of the front and back belt segments.

23. The convertible harness of claim 22, wherein said proximal ends of said elongated leg straps are operatively connected to said front belt segment and said proximal ends of said minor straps are operatively connected to said back belt segment.

24. The convertible harness of claim 22, wherein said secondary straps are operatively connected to said front belt segment.

25. The convertible harness of claim 18, further comprising a D-ring attachment operatively connected to said waist belt portion.

26. The convertible harness of claim 25, wherein the D-ring attachment is positioned between the proximal ends of the secondary straps.

27. The convertible harness of claim 18, further comprising at least one control tab configured and arranged to stow at least a portion of said second and third fastener portions.

28. The convertible harness of claim 18, wherein the waist belt portion includes a front belt segment, a back belt segment, and an A-frame belt segment.

29. The convertible harness of claim 28, wherein said A-frame belt segment includes a central region interconnecting a left side and a right side, the central region configured and arranged to be operatively connected to a carabineer, a sliding D-ring attachment being operatively connected to one of the left side or the right side.

30. The convertible harness of claim 18, further comprising attachment points operatively connected to a left side, a right side, and a front side of said waist belt portion, said attachment points configured and arranged to operatively connect to a chest harness.

31. The convertible harness of claim 30, said chest harness including a front strap configured and arranged to connect to the front side attachment point, a left rear strap configured and arranged to connect to the left side attachment point, and a right rear strap configured and arranged to connect to the right side attachment point.

32. A method of using a convertible harness configured to convert between a suspension harness configuration and a seat harness configuration, the harness being adapted to secure to a user, the method comprising the steps of:

a) securing a waist belt portion of said convertible harness, said convertible harness comprising:

i) said waist belt portion having a front belt segment and a back belt segment and an attachment member configured to open and close an attachment of said belt portion configured to be secured on a user's waist;

ii) a pair of elongated leg straps each having a proximal and a distal end, said proximal end being arranged on said waist belt, said distal end terminating at a fastening member;

iii) a pair of minor straps each having a proximal and a distal end, said proximal end of each of said minor straps being arranged on said waist belt, said distal end of each of said minor straps terminating at a mating fastening member configured to mate with a respective one of said fastening members of said elongated leg straps to convert said convertible harness into the suspension harness configuration;

iv) a pair of secondary straps each having a secondary mating fastening member configured to mate with a respective one of said fastening members of said elongated leg straps to convert said convertible harness into the seat harness configuration; and v) said proximal end of said minor straps having a loop surrounding said waist belt portion in a manner which allows said minor straps to slide to and fro with respect to a major longitudinal axis of said waist belt portion and pivot along said waist belt portion, said loops surrounding said waist belt portion forming leg loop attachment points for said suspension harness configuration;

b) fastening said elongated leg straps to said minor straps to convert said harness into said suspension harness configuration;

c) unfastening said elongated leg straps from said minor straps;

d) fastening said elongated leg straps to said secondary straps to convert said harness to said seat harness configuration;

whereby, when said mating fastening members of said minor straps are matingly fastened to said fastening members of said elongated leg straps a pair of leg loops are formed to convert said harness into said suspension harness configuration, and whereby when said secondary mating fastening members of said secondary straps are matingly fastened to said fastening members of said elongated leg straps a pair of thigh loops are formed to convert said harness into said seat harness configuration.

33. The method of using the convertible harness as recited in claim 32, wherein said convertible harness further comprises a yolk adapted to be attached to said convertible harness to convert said convertible harness into a convertible chest harness.

* * * * *